US005418425A

United States Patent [19]

Bachmor et al.

[11] Patent Number: 5,418,425

[45] Date of Patent: May 23, 1995

[54] MULTISTAGE COLLECTOR FOR ELECTRON-BEAM TUBES HAVING COLLECTOR ELECTRODES INDIRECTLY CONNECTED BY COLLAR MEMBERS

[75] Inventors: Rudolf Bachmor, Quickborn; Bernd Offerman; Horst Seifert, both of Hamburg, all of Germany

[73] Assignee: U.S. Philips Corporation, New York, N.Y.

[21] Appl. No.: 8,941

[22] Filed: Jan. 26, 1993

[30] Foreign Application Priority Data

Feb. 7, 1992 [DE] Germany ..... 42 03 487.6

[51] Int. Cl.[6] ..... H01J 23/027; H01J 23/033

[52] U.S. Cl. ..... 315/5.38; 313/45; 313/46

[58] Field of Search ..... 315/5.38; 313/45, 46

[56] References Cited

U.S. PATENT DOCUMENTS 3,368,104 2/1968 McCullough ..... 315/5.38
3,995,193 11/1976 Horigome et al. ..... 315/5.38
5,177,394 1/1993 Kubo ..... 315/5.38 X

FOREIGN PATENT DOCUMENTS 2636913 6/1985 Germany .
214327 1/1988 Japan ..... 315/5.38
109234 4/1990 Japan ..... 315/5.38

*Primary Examiner*—Benny T. Lee
*Attorney, Agent, or Firm*—Robert J. Kraus

[57] ABSTRACT

A multistage collector for electron-beam tubes, in particular for klystrons, comprising a plurality of electrode rings (7 to 11) which are arranged one behind the other in the direction of the electron beam and which are connected to gradually decreasing electric potentials, and comprising insulating ceramic spacer rings (12 to 16) which interconnect adjacent electrode rings (7 to 11) in an electrically insulating vacuum-tight manner. Flashovers between the collector stages are precluded in that radially outwardly extending first ring-shaped metal casings (19, 20), which can be manufactured in a simple manner are soldered in a vacuum-tight manner to the end regions of the spacer rings (12 to 16), and in that second ring-shaped metal casings (21, 22) are soldered in a vacuum-tight manner to the electrode rings (7 to 11), an annular disc area (21*a*, 22*a*) of each of said ring-shaped casings engaging an associated annular disc area (19*a*, 20*a*) of a first ring-shaped casing (19, 20) and said annular disc areas being welded together in a vacuum-tight manner, so that two welding collars are formed, and in that the ambient air-accessible outer surfaces of the ring-shaped metal casings (19 to 22) and hence the welding collars are covered by an insulating material.

6 Claims, 1 Drawing Sheet

MULTISTAGE COLLECTOR FOR ELECTRON-BEAM TUBES HAVING COLLECTOR ELECTRODES INDIRECTLY CONNECTED BY COLLAR MEMBERS

BACKGROUND OF THE INVENTION

The invention relates to a multistage collector for electron-beam tubes, in particular for klystrons, comprising a plurality of electrode rings which are arranged one behind the other in the direction of the electron beam and which are connected to gradually decreasing electric potentials, and comprising insulating ceramic spacer rings which interconnect adjacent electrode rings in an electrically insulating manner.

A radiation-cooled multistage collector of this type is described in DE-PS 26 36 913.

SUMMARY OF THE INVENTION

It is an object of the invention to provide a multistage collector of the type mentioned in the opening paragraph, which can be manufactured in a simple manner and in which flashovers between the collector stages are precluded.

This object is achieved in that radially outwardly extending first ringshaped metal casings are soldered, in a vacuum-tight manner, to the end regions of the spacer rings, and in that second ring-shaped metal casings are soldered, in a vacuum-tight manner, to the electrode rings, an annular disc area of each of said second ring-shaped casings engaging an associated annular disc area of a first ring-shaped casing and said annular disc areas being welded together in a vacuum-tight manner, so that two welding collars are formed, and in that the ambient air-accessible outer surface of the ring-shaped metal casings and hence the welding collars are covered by an insulating material.

In accordance with the invention, the adjacent collector stages can be connected to the ceramic spacer rings in a simple, reliable and vacuum-tight manner. Although the interspace between the welding collars situated next to the spacer rings is relatively small, flashover is precluded by the coating of insulating material.

In the method in accordance with the invention, no metallic surfaces are in direct contact with the ambient air. The formation of leakage paths is precluded. This is important for, in particular, air-cooled collectors, because the cooling air flow contacting the collectors may contain dust particles which can deposit on the outer surfaces of the welding collar and of the ceramic spacer rings, so that leakage paths may be formed, in particular, if the cooling air has a high degree of humidity. Ionization of air at the sharp edges of the welding collar, which would increase the risk of flashovers, is avoided.

After the collars have been obtained by welding, the insulating material can be applied as a covering layer by means of a brush or by spraying. However, in a preferred embodiment, the insulating material is provided in the form of an elastic protective ring. Such a protective ring is preformed in accordance with the contours to be covered and is elastically, tightly provided after the collars have been welded. In this manner, a smooth surface with respect to the ambient air is obtained which offers little resistance to the cooling air flowing past it, and hence the amount of noise produced by said air flow is reduced.

Preferably, the insulating material consists of soft-elastic silicone rubber. This material has a favourable dielectric strength. A protective ring of said soft-elastic material can be stretched considerably, so that it can be guided past other collector stages during mounting and provided in a simple manner.

In accordance with a particularly advantageous embodiment, the interspace between adjacent welding collars is completely filled with dielectric insulating material. This prevents the occurrence of air paths between two welding collars in the direction of the gradient of the electric field strength, so that the flashover resistance is determined exclusively by the high dielectric strength of the insulating material. Also, the fact that the insulating material has a higher relative dielectric constant than air leads to the additional advantage that the capacitance between two collector stages is increased. By virtue thereof, the degree of high frequency stray radiation is substantially reduced.

In an air-cooled embodiment of the invention, the electrode rings are provided with radially extending cooling fins which are air-cooled and extend only axially longitudinally beyond the ceramic spacer rings. The axial distance between the cooling fins of adjacent collector stages suffices to preclude flashover.

BRIEF DESCRIPTION OF THE DRAWINGS

The invention will be explained in greater detail by means of an exemplary embodiment and with reference to the accompanying drawing, in which FIG. 1 diagrammatically shows a klystron comprising a multistage aircooled collector.

DESCRIPTION OF THE PREFERRED EMBODIMENT

Figure 1:
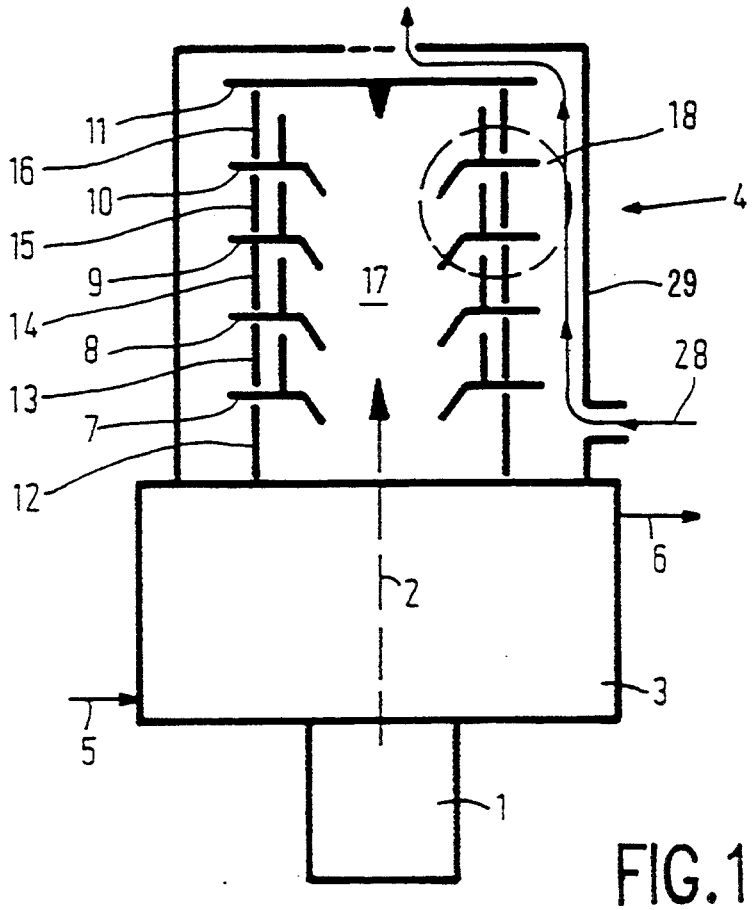

In the klystron shown in FIG. 1, an electron gun 1 emits an electron beam 2 which passes through the tube section 3 and into the multistage collector 4. In the collector the electrons of the electron beam 2 are collected.

Tube section 3 essentially comprises drift paths, resonators and magnets (not shown) for focusing the electron beam. In the lower region, HF-control energy is supplied to a resonator in the tube section 3 (arrow 5). In the upper region HF energy is taken from a resonator in tube section 3 (arrow 6).

The multistage collector 4 comprises five electrodes 7, 8, 9, 10 and 11, and ceramic spacer rings 12, 13, 14, 15 and 16, which provide the defined interspace between the electrodes 7, 8, 9, 10 and 11, which are insulated from each other. As the interior 17 of the collector is under a vacuum, the spacer rings must be connected to adjacent electrodes in a vacuum-tight manner.

The electrodes 7, 8, 9, 10 and 11 are at different potentials. For example, the final electrode 11 is at a potential of −24 kV, i.e. the same potential as that of the cathode of electron gun 1. Electrodes 10, 9, 8 and 7 are at a potential of, for example, −18 kV, −12 kV, −6 kV and "0" kV, respectively. Dependent upon the velocity of the electrons of the electron beam 2, the electrons are collected by one of the electrodes 7, 8, 9, 10 or 11. The air flow (arrow 28) between the casing 29 and the outer surfaces of the collector stages consists of cooling air through which the heat formed when the electrons collide with the electrodes 7, 8, 9, 10 and 11 is exhausted.

Figure 2:
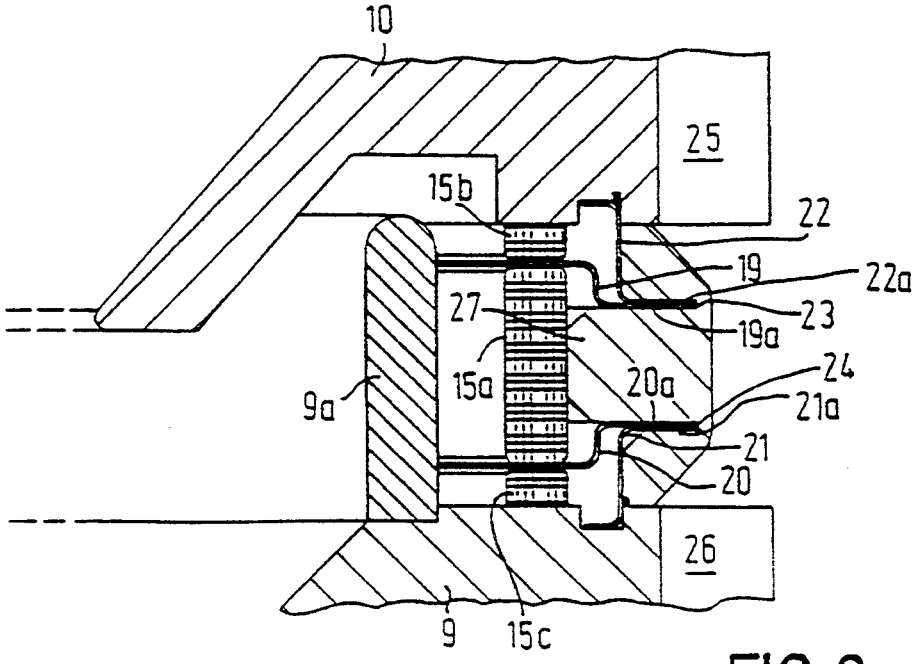
FIG. 2 shows, for an area 18 of FIG. 1, an inventive embodiment of the connection area between two collector stages.

The inventive connection between the ceramic spacer rings and adjacent electrodes is shown in FIG. 2 for an encircled area 18 of FIG. 1.

The electrodes and the ring-shaped portions (9*a* in FIG. 2) provided thereon consist of copper. As it is difficult to directly solder the ceramic spacer rings 12 to 16 to copper, an indirect connection is formed through copper/nickel alloy ring-shaped casings 19 and 20, which are soldered between the ring portions 15*a*, 15*b* and 15*a*, 15*c*, respectively, of the ceramic spacer ring 15, and to ring-shaped casings 21 and 22 which are soldered to adjacent electrodes 9 and 10, respectively.

The annular discs 19*a* and 22*a* on the one hand and 20*a* and 21*a* on the other hand lie against each other and are welded together in a vacuum-tight manner at their end portions 23 and 24, respectively.

The annular discs 19*a* and 22*a* on the one hand and the annular discs 21*a* and 20*a* on the other hand form welding collars which are at a much smaller distance from each other than the cooling fins 25 and 26 which extend radially from the electrodes 9 and 10, respectively. Flashovers between oppositely located welding collars cannot take place because their metallic surfaces are covered by the protective ring 27 which elastically, tightly engages the covered metallic surfaces and the ring portion 15*a* of the ceramic spacer ring. The protective ring 27 which consists of soft-elastic silicone rubber can be stretched during mounting. As the outer surface of the protective ring 27 is smooth and enhances the flow of cooling air, the flow resistance of the cooling air flowing from cooling fin 26 to cooling fin 25 is low, and the noise level is reduced correspondingly.

The relatively small distance between the welding collars in combination with the intermediate dielectric material of the protective ring 27 brings about an increase of the capacitance between the adjacent electrodes 9 and 10, so that HF stray radiation is reduced. As silicone rubber has a high dielectric constant it can also very suitably be used for this purpose.

We claim:

1. A multistage collector for an electron-beam tube, said collector comprising at least first and second adjacent annular electrodes surrounding an axis along which an electron beam propagates and being separated by an annular insulator to facilitate operation of said electrodes at different potentials, characterized in that:

a. said annular insulator is indirectly connected to the first and second adjacent annular electrodes by attachment means comprising:

i. first and second metallic annular members attached in a vacuum-tight manner to the first and second annular electrodes, respectively, each of said first and second members having an annular-disc-shaped portion extending radially outwardly from said annular insulator;

ii. third and fourth metallic annular members attached in a vacuum-tight manner to respective axially-spaced portions of said annular insulator, each of said third and fourth members having an annular-disc-shaped portion extending radially outwardly from said annular insulator and being attached in a vacuum-tight manner to a respective one of the annular-disc-shaped portions of the first and second members to define first and second spaced-apart collar members; and b. the collar members have ambient-air-accessible surfaces which are covered by an insulating material.

2. A multistage collector as in claim 1 where said insulating material comprises an elastic covering member.

3. A multistage collector as in claim 1 or 2 where said insulating material comprises a soft elastic silicone rubber.

4. A multistage collector as in claim 1 or 2 where a space between said collar members is filled with insulating material.

5. A multistage collector as in claim 1 or 2 where the first and second annular electrodes are provided with radially extending cooling fins.

6. An electron-beam tube including a multistage collector comprising at least first and second adjacent annular electrodes surrounding an axis along which an electron beam propagates and being separated by an annular insulator to facilitate operation of said electrodes at different potentials, characterized in that:

a. said annular insulator is indirectly connected to the first and second adjacent annular electrodes by attachment means comprising:

i. first and second metallic annular members attached in a vacuum-tight manner to the first and second annular electrodes, respectively, each of said first and second members having an annular-disc-shaped portion extending radially outwardly from said annular insulator;

ii. third and fourth metallic annular members attached in a vacuum-tight manner to respective axially-spaced portions of said annular insulator, each of said third and fourth members having an annular-disc-shaped portion extending radially outwardly from said annular insulator and being attached in a vacuum-tight manner to a respective one of the annular-disc-shaped portions of the first and second members to define first and second spaced-apart collar members; and b. the collar members have ambient-air-accessible surfaces which are covered by an insulating material.

* * * * *